US005127753A

United States Patent [19]

Shibaoka

[11] Patent Number: 5,127,753

[45] Date of Patent: Jul. 7, 1992

[54] PRINTER WITH AREA DEFINED AND CHARACTER DEFINED ERASING PATTERNS

[75] Inventor: Hideo Shibaoka, Yokohama, Japan

[73] Assignee: Canon Kabushiki Kaisha, Tokyo, Japan

[21] Appl. No.: 458,441

[22] Filed: Dec. 28, 1989

[30] Foreign Application Priority Data

Jan. 27, 1989 [JP] Japan ..... 1-016169

[51] Int. Cl.[5] ..... B41J 29/36

[52] U.S. Cl. ..... 400/695; 400/63

[58] Field of Search ..... 400/63, 74, 695-697.1

[56] References Cited

U.S. PATENT DOCUMENTS

| | | | |
|---|---|---|---|
| 4,545,693 | 10/1985 | Bartlett | 400/696 |
| 4,572,687 | 2/1986 | Croley | 400/696 |
| 4,728,209 | 3/1988 | Kumamoto | 400/697.1 |
| 4,749,289 | 6/1988 | Sugiura | 400/696 |

FOREIGN PATENT DOCUMENTS

| | | | |
|---|---|---|---|
| 78683 | 4/1986 | Japan | 400/695 |
| 172771 | 8/1986 | Japan | 400/695 |
| 280972 | 12/1986 | Japan | 400/695 |
| 87366 | 4/1987 | Japan | 400/695 |
| 17071 | 1/1988 | Japan | 400/695 |
| 94872 | 4/1988 | Japan | 400/695 |
| 166579 | 7/1988 | Japan | 400/695 |
| 166580 | 7/1988 | Japan | 400/695 |
| 166581 | 7/1988 | Japan | 400/695 |

*Primary Examiner*—David A. Wiecking
*Assistant Examiner*—Steven S. Kelley
*Attorney, Agent, or Firm*—Fitzpatrick, Cella, Harper & Scinto

[57] ABSTRACT

A document processing apparatus comprises an element for editing input character data an element for recording and outputting the input or edited character data, and an element for erasing the recorded and output character data. A plurality of different erasing systems are provided for the erasing element. The optimum erasing system is selected from the plurality of different erasing systems of the erasing element in accordance with predetermined processing conditions of the apparatus. The recorded and output character data is erased. The optimum erasing system can be selected in accordance with the printing system of the recorded characters, dot density, presence or absence of the character data in the memory, and presence of superimposed characters so that the low electric power consumption and the optimum erasing quality can be realized.

62 Claims, 5 Drawing Sheets

PRINTER WITH AREA DEFINED AND CHARACTER DEFINED ERASING PATTERNS

BACKGROUND OF THE INVENTION

1. Field of the Invention

The present invention relates to a document processing apparatus having means for erasing character data which was recorded and output.

2. Related Background Art

Hitherto, in an electronic typewriter or the like, particularly, in a document having a sequential print mode or the like, an apparatus for erasing the printed characters has been known. In the case of a printer such as impact printer, thermal copy transfer printer, or the like using a recording section of the type for copy transferring the ink of an ink ribbon onto a recording paper, the printed characters are erased by a method whereby the ink which was copy transferred onto the recording paper is peeled off or shaded or the like.

On the other hand, in an apparatus such that character data is stored and buffered into a memory on a unit basis of the line, page, or the like and the buffered characters are edited and, thereafter, they are printed, the information such as kind, print, and the like of the character data can be known in accordance with the content in the memory. Therefore, a technique to erase by giving such information to a printing mechanism has been known.

Although the erasing method by the printing mechanism differs depending on the printing system, the system for thermally copy transferring the ink from the ink ribbon by using a thermal head uses the following two kinds of methods. Consideration will now be made with respect to the case where a character C ("F") has already been printed on a recording paper P as shown in FIG. 5A and this character is erased.

1) A font pattern of a character B as shown in FIG. 5B (hereinafter, such a font pattern is referred to as a box font) which was thickened by turning on eight dots surrounding each dot of the dot pattern (hereinafter, referred to as a font) of the printed character C stored in the memory is made. The thermal head is positioned over the character C. The portion of the thermal head corresponding to the character C is heated by using the box font and the ink is peeled off from the recording paper P.

2) As shown in FIG. 5C, the thermal head is positioned over the character C by using the dot pattern (hereinafter, such a dot pattern is referred to as an area-erasing font) which is derived by turning on all of the dots in a range of the character C on the basis of the character width and height thereof with reference to the content of the memory. Then, the ink is peeled off from the whole character print area by the thermal head.

The above two erasing methods by the thermal copy transfer system have the following problems.

First, in the case of using the box font as shown in FIG. 5B, since the box font is formed by using the data of the ordinary character font for printing, it takes a relatively long time. On the other hand although it is also possible to use a font memory only for use of the box font, in this case, a large memory capacity is needed only to erase. Further, in the case where a plurality of characters were superimposed and printed at the same position on the recording paper or in the case where a plurality of characters were superimposed and printed at point positions which are slightly shifted, there are problems such that it takes time for a process to erase the superimposed characters printed at the same print position one character by one and a part of the recording paper is overlappingly peeled off, so that the printing quality deteriorates.

In the case of using the area-erasing font, there are the following problems. First, since the heating area of the thermal head is wide, electric power consumption is large. Therefore, a voltage drop occurs depending on a power source impedance and the sufficient erasure cannot be executed. On the other hand, in an apparatus which is driven by a battery or the like, the life of the battery is short. Further, since the paper in the portion where no ink is deposited is also peeled off, there is also a problem such that if a character of a small dot density of the font was erased, the recording quality of the recording paper deteriorates or the like.

SUMMARY OF THE INVENTION

To solve the above-mentioned problems, it is an object of the present invention to provide a document processing apparatus comprising means for editing input character data, means for recording and outputting the input or edited character data, and means for erasing the recorded and output character data, wherein a plurality of different erasing systems are provided for the erasing means. The optimum erasing system is selected from the plurality of different erasing systems of the erasing means in accordance with predetermined processing conditions of the apparatus, and the recorded and output character data is erased.

Another object of the invention is to provide a document processing apparatus in which the optimum erasing system is selected from a plurality of different erasing systems of the erasing means in accordance with predetermined processing conditions of the apparatus and the recorded and output character data can be erased.

Still another object of the invention is to provide a document processing apparatus comprising erasing means for erasing a recorded character pattern, and discriminating means for discriminating whether the recorded character pattern corresponds to superimposed characters or not. If it is decided by the discriminating means that the character pattern corresponds to the superimposed characters, the erasing process by the erasing means is executed by using an area-erasing pattern.

Still another object of the invention is to provide a document processing apparatus comprising storing means for storing a predetermined amount of a recorded character pattern, discriminating means for discriminating whether character pattern data to be erased has been stored in the storing means or not, and determining means for determining whether an area-erasing pattern is used or a character pattern corresponding to the recorded character pattern is used on the basis of the result of the discrimination by the discriminating means.

Still another object of the invention is to provide a document processing apparatus comprising discriminating means for discriminating a ratio of the number of dots of a character pattern to be erased which occupies in a predetermined area, determining means for determining an erasing mode in accordance with a dot density which is discriminated by the discriminating means, and erasing means for executing an erasing operation in accordance with the erasing mode determined by the determining means.

Still another object of the invention is to provide a document processing apparatus comprising holding means for holding data of recorded characters, first discriminating means for discriminating whether data corresponding to the characters to be erased has been held in the holding means or not, second discriminating means for discriminating the kind of recorded characters on the basis of the data held in the holding means, third discriminating means for discriminating a recording density of the recorded characters, and control means for controlling an erasing mode of the recorded characters on the basis of the results of the discrimination by the first to third discriminating means.

DERAILED DESCRIPTION OF THE PREFERRED EMBODIMENTS

Figure 1:
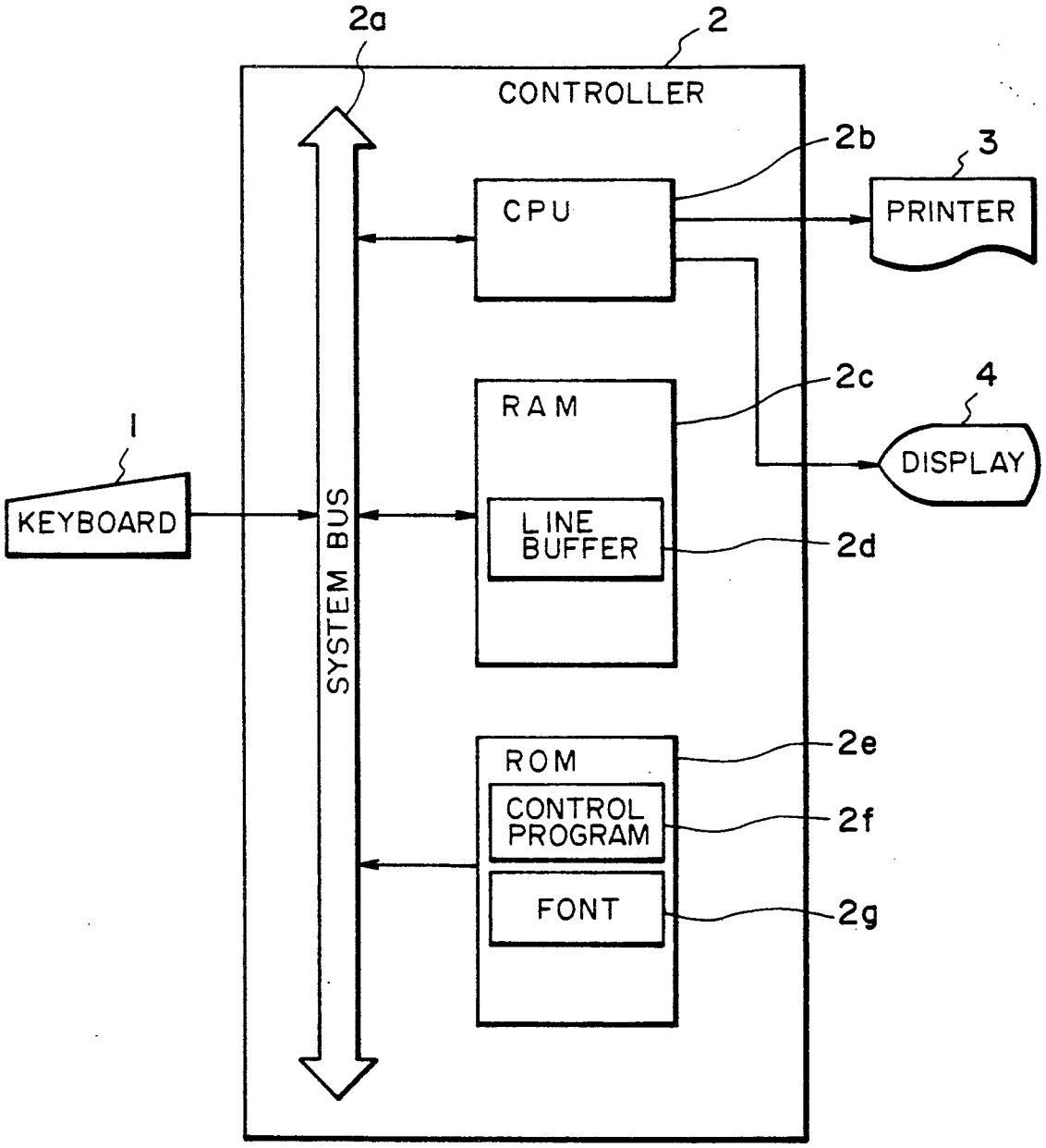
FIG. 1 is a block diagram showing a construction of a document processing apparatus to which the present invention is applied.

FIG. 1 shows a construction of a document processing apparatus to which the invention is applied. In FIG. 1, reference numeral 1 denotes a keyboard having character keys and various function keys (not shown). By depressing those keys, character data to be printed is input to a controller 2. The controller 2 mainly comprises a CPU *2b*, an RAM *2c*, and an ROM *2e*. The components *2b*, *2c*, and *2e* are connected to a system bus *2a* of the CPU *2b*.

In accordance with information which was input from the keyboard 1, the CPU *2b* controls the printing operation of a printer 3 comprising a thermal printer and the display operation of a display 4 comprising an LCD panel and the like. In this case, control programs of the CPU *2b* are stored in an area *2f* in the ROM *2e*. On the other hand, an area *2g* for character fonts which are used to print by the printer 3 is provided in the ROM *2e*.

On the other hand, the edition and print of characters are executed on a unit basis of a character string of one line. A line buffer area *2d* to store the character string of a predetermined number of characters is provided in the RAM *2c*.

As mentioned above, the printer 3 is of the thermal copy transfer type and can erase the printed characters by the two erasing methods of the method using the box font and the method using the area-erasing font which have been described in the conventional example. The box font which is used in the invention incorporates the font in which one font was thickened as mentioned above and the font which previously has a thickened pattern as a font.

The CPU *2b* can designate and use either one of the two erasing methods.

[The erasing mode is changed by the kind of character]

Figure 2:
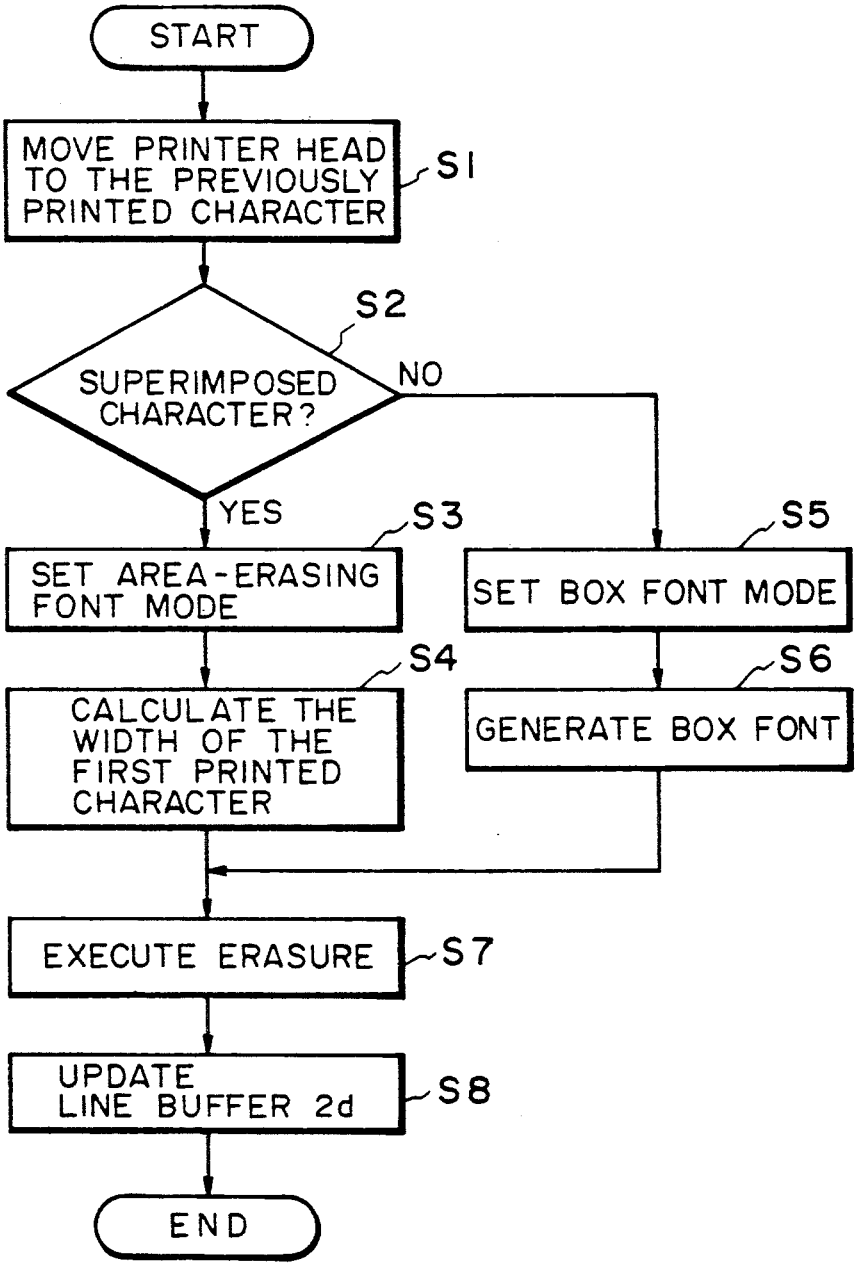
FIGS. 2 to 4 are flowcharts showing different control procedures of a CPU in FIG. 1.

The operation in the above construction will now be described. FIG. 2 shows a control procedure in the erasing mode of the CPU *2b* which has been stored in the ROM *2e*.

The procedure of FIG. 2 is executed when the erasure of the printed characters was designated by the depression of an erasure key from the keyboard 1 or the like. In this example, FIG. 2 shows the case of erasing one character which was just previously printed.

In step S1 in FIG. 2, a recording head of the printer 3 is moved to the left by a predetermined print pitch and to the position of the just previously printed character. In step S2, the content of the line buffer *2d* in the RAM *2c* is checked to see if the character printed at that position is the superimposed character or not. As a superimposed character, there is a bold face pattern in which the same character was shifted and printed at a fine pitch or the like. It is also possible to consider that the superimposed character incorporates , "¥", "$a^2$", "½", or the like. If it is determined in step S2 that the character at the printing position is the superimposed character, step S3 follows. If NO, step S5 follows.

In step S3, the erasing mode of the printer 3 is set into the mode using the area-erasing font. For this purpose, a flag which was set in a predetermined address in the RAM *2c* is set into the area-erasing font mode.

In the next step S4, in order to set the character width of the area-erasing font, the line buffer *2d* is referred and the width of the character which was first printed among the superimposed characters at the printing positions is calculated. The value of the character width is stored in a predetermined recording area in the RAM *2c*.

Figures 5A, 5B, 5C:
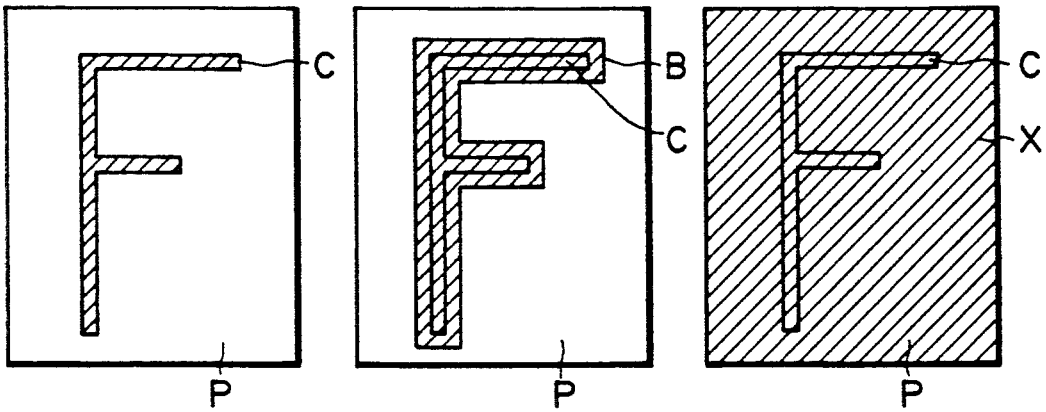
FIGS. 5A to 5C are explanatory diagrams showing different methods of erasing a printed character.

On the other hand, in step S5, the erasing mode is set into the box font mode. For this purpose, a predetermined flag in the RAM *2c* is set so as to use a box font. In step S6, a box font as shown in FIG. 5B is generated from the font of the character which has already been printed at the printing position. It is also possible to previously form such a box font for each character and to store as a font into the ROM *2e*.

In step S7, the printer 3 is driven, the ink at the printing position is peeled off, and the erasure is executed on the basis of the conditions which were set in steps S3 and S4 or steps S5 and S6. In step S8, the character data in the line buffer *2d* is updated and the character data in the memory is made to coincide with the print character.

According to the above control, in the case of the superimposed characters, the erasure is executed by the erasing method using the area-erasing font, while in the case of the characters other than the superimposed characters, the erasure is performed by the method using the box font. Therefore, in the case of the superimposed characters, the whole superimposed characters can be certainly erased by using the area-erasing font. On the other hand, in the case of the characters other than the superimposed characters, the peel-off area is reduced by using the box font and a good recording quality can be realized.

Figure 3:
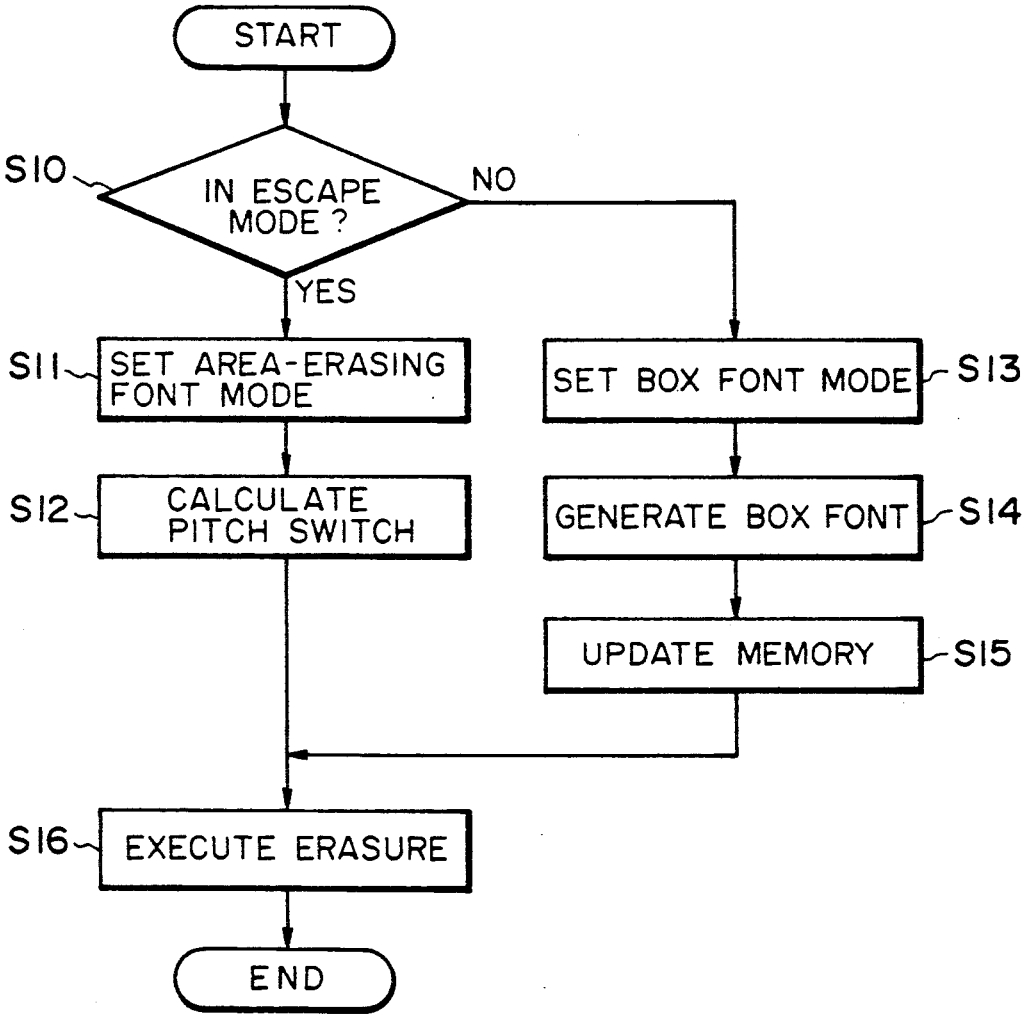

The example in which the erasing mode is switched in accordance with the kind of characters to be erased has been shown above. FIG. 3 shows a method of switching the erasing mode in accordance with whether the information of the characters to be erased has been stored or not.

[The erasing mode is switched in accordance with whether the information of the characters to be erased has been stored or not]

In general, the memory capacities of the line buffer 2d and the other memories are limited. After completion of the process of a predetermined unit such as printing of one line or the like, the data in the buffer or memory is erased. Therefore, in the case of erasing the characters which is preceding by one line or the like, there is considered a case where the information regarding the characters to be erased is not stored into the memory.

Hitherto, in the case of erasing the characters which do not exist in the record, a predetermined key of the keyboard 1 is depressed and the processing mode is set into a special processing mode called an escape mode or the like, thereby erasing the characters. In the conventional erasing mode, characters to be erased are obscure, so that the operator needs to designate the kind of characters to be erased by the position of the keyboard. The control of FIG. 3 intends to solve such a problem.

In step S10 in FIG. 3, a check is made to see if the processing mode is the escape mode or not. Such a discrimination can be executed by checking a state of a flag or the like in the RAM 2c which is set in response to a predetermined key operation which is performed by the keyboard 1. In the escape mode, step S11 follows. If the processing mode is not the escape mode, step S13 follows. In step S11, in a manner similar to step S3 in FIG. 2, the erasing mode is set into the area-erasing font mode. In step S12, the width of the character of the area-erasing font is set. In this case, a value of a pitch switch to set a character pitch which has been set to the keyboard 1 is used.

On the other hand, if the processing mode is not the escape mode, step S13 follows and in a manner similar to step S5, the erasing mode is set into the erasing mode using the box font. In step S14, the box font is generated.

If the processing mode is not the escape mode, this means that the erasing mode has been stored in the memory, so that in step S15, the content of the memory is erased and updated to the same state as that after completion of the erasure.

In step S16, the erasure is executed by the printer 3 on the basis of the conditions which were set in steps S11 and S12 or steps S13 to S15.

According to the control of FIG. 3, if the processing mode has been set into the escape mode, that is, if a character to be erased does not exist in the line buffer 2d, the erasure is executed by using the area-erasing font. Therefore, the necessity such that the user designates the kind of characters to be erased from the keyboard 1 as in the conventional method is eliminated and there is an advantage such that the printed characters can be automatically erased.

[The erasing mode is changed in accordance with the printing density]

Figure 4:
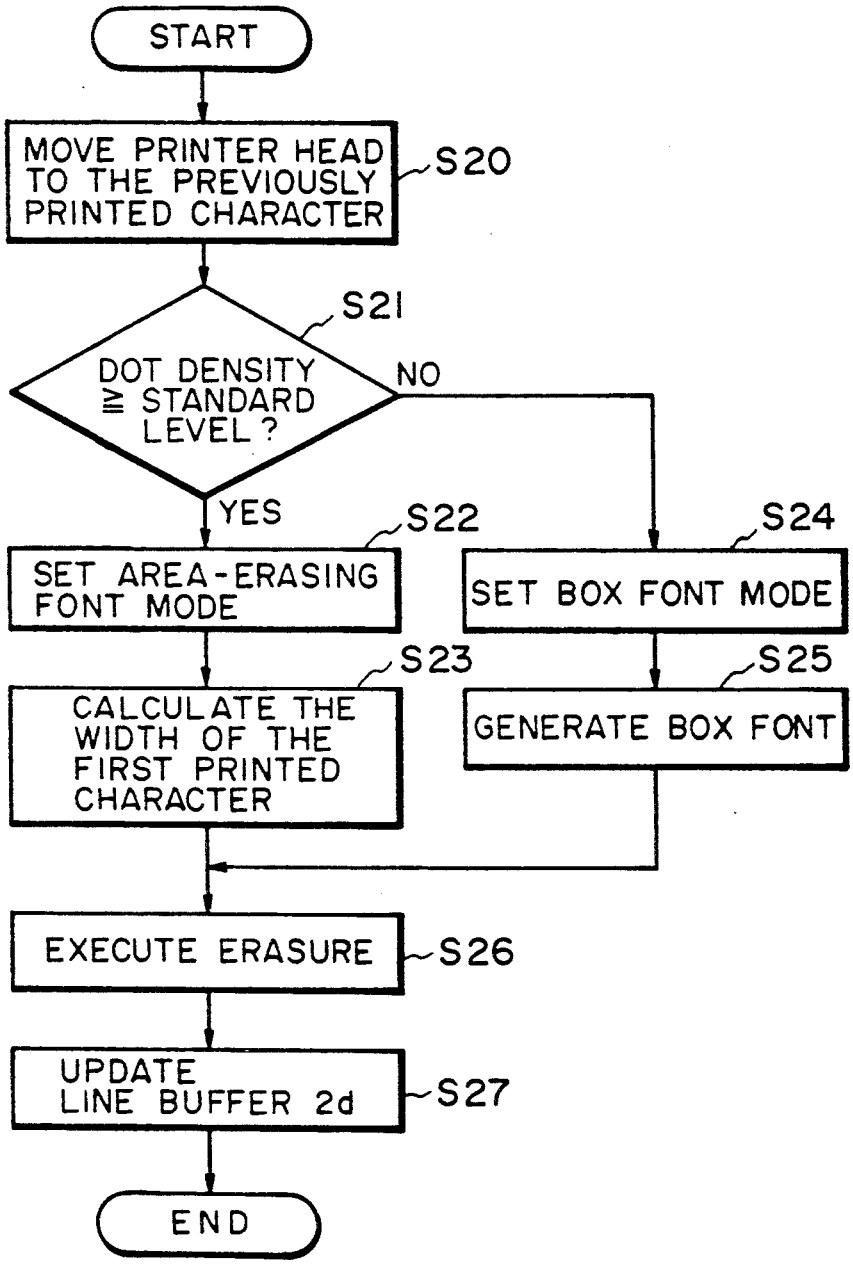

FIG. 4 further shows a different control procedure. The procedure of FIG. 4 relates to an example in which two erasing modes are switched in accordance with the dot density of the printed character to be erased.

In step S20 in FIG. 4, in a manner similar to step S1 in FIG. 2, the recording head is moved to the left and is positioned over the character which has just previously been printed.

In step S21, a check is made to see if the dot density which is expressed by the number of dots per unit area of the printed character is a standard value of greater, or less than the standard value. The dot density corresponds to the number of dots which are printed in the area corresponding to a predetermined character pitch. A check is made to see if the dot density is at least the standard value or less than such using a table or the like which has been preset in the ROM 2e. If the dot density of the printed character to be erased is at least the standard value, step S22 follows. If the dot density is smaller than the standard value, step S24 follows.

Steps S22 to S27 are substantially the same as steps S3 to S8 in FIG. 2. According to the procedure of FIG. 4, when the dot density of the printed character to be erased is high, that is, if a large number of dots have been recorded in the print pitch, the area-erasing font is used. If the dot density is small, namely, when the number of dots in a predetermined printing pitch is small, the erasure is executed by using the box font. Therefore, the character of a high dot density can be efficiently erased with good quality. On the contrary, in the case of a character of a small dot density, the peeloff area is reduced by suing the box font and effective erasure can be similarly achieved. Further, since the area-erasing font of a large electric power consumption is used only to erase the character of a predetermined dot density or larger, the character can be efficiently erased with small electric power consumption.

[Combination of three controls]

Figure 6:
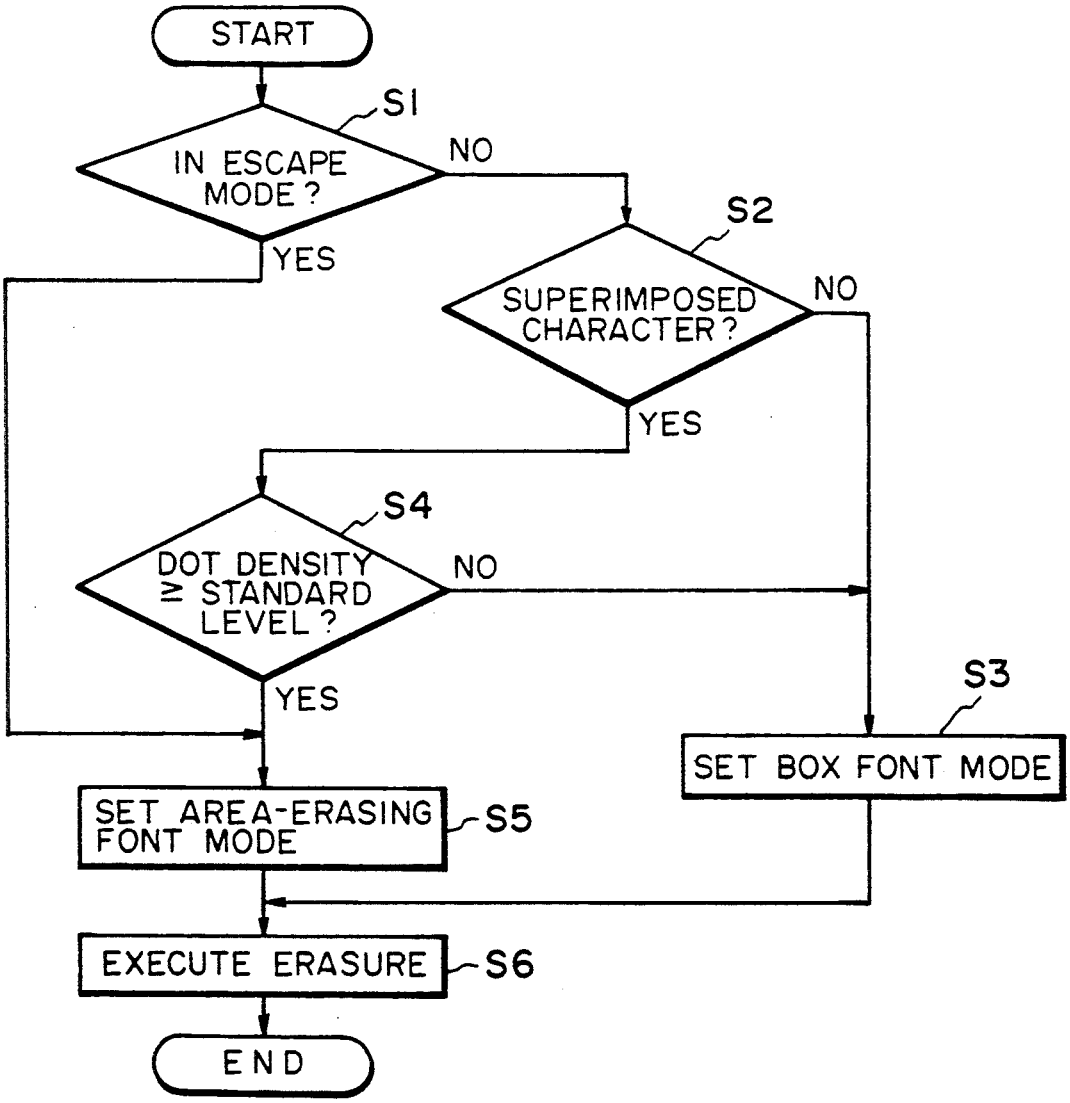
FIG. 6 is a flowchart showing a control procedure of the erasing mode by a combination of the three methods.

The examples of the three control procedures have been described above by the different flowcharts. FIG. 6 shows an example in which those three control procedures can be all combined and used.

In FIG. 6, in the escape mode, the area-erasing font mode is unconditionally used (steps S1, S5). On the other hand, in the erasing mode of the superimposed characters, a dot density is checked (S4) and either the area-erasing font (S4, S5) or the box font (S4, S3) is selected.

As will be obvious from the above description, according to the invention, in a document processing apparatus having the means for editing input character data, the means for recording and outputting the input or edited character data, and the means for erasing the recorded and output character data, a plurality of different erasing systems are provided for the erasing means. The optimum erasing system is selected from the plurality of different erasing systems of the erasing means in accordance with predetermined processing conditions of the apparatus, and the recorded and output character data is erased. Therefore, the optimum erasing system is selected from the plurality of different erasing systems of the erasing means in accordance with predetermined processing conditions of the apparatus and the recorded and output character data can be erased. There are excellent advantages such that, for instance, the optimum erasing system can be used in accordance with the printing system of the recorded characters, dot density, presence or absence of the character data in the memory, and the like, and the optimum conditions can be set with respect to the electric power consumption, erasing quality, and the like.

I claim:

1. A document processing apparatus comprising:

erasing means for erasing a recorded character pattern, said erasing means capable of erasing an area pattern defined by the width and height of the recorded character and erasing a character pattern defined by the recorded character; and discriminating means for discriminating whether the recorded character pattern is comprised of superimposed characters, wherein if it is discriminated by said discriminating means that the character pattern comprises superimposed characters, said erasing means executes an erasing process erasing the area pattern, and if it is discriminated that the character pattern does not comprise superimposed characters, said erasing means executes an erasing process by erasing the character pattern defined by the recorded character.

2. A document processing apparatus comprising:

storing means for storing recorded character patterns;

erasing means for erasing a recorded character pattern, said erasing means capable of erasing an area pattern defined by the width and height of the recorded character and erasing a character pattern defined by the recorded character;

discriminating means for discriminating whether the character pattern to be erased has been stored in said storing means; and determining means for determining whether to erase the area pattern or the character pattern based on the results of the discrimination by said discriminating means, wherein said erasing means executes an erasing operation by erasing the area pattern when it is discriminated that the character pattern is not stored in said storing means, and erased the character pattern by erasing the character pattern defined by the recorded character when it is discriminated that the character pattern is stored in said storing means.

3. A character processing apparatus comprising:

erasing means for erasing a recorded character pattern, said erasing means capable of erasing an area pattern defined by the width and height of the recorded character and erasing a character pattern defined by the recorded character;

discriminating means for discriminating a dot density of a character pattern to be erased by determining the number of dots comprising the character pattern and comparing the dot density with a prestored standard dot density;

determining means for determining an erasing mode in accordance with the dot density discriminated by said discriminating means, wherein said erasing means executes an erasing operation by erasing the area pattern when it is discriminated that the dot density is equal to or greater than the standard dot density, and by erasing the character pattern defined by the recorded character when it is discriminated that the dot density is less than the standard dot density.

4. A character processing apparatus comprising:

erasing means for erasing a recorded character pattern, said erasing means capable of erasing an area pattern defined by the width and height of the recorded character and erasing a character pattern defined by the recorded character;

memory means for storing data of recorded characters;

first discriminating means for discriminating whether data corresponding to the characters to be erased is stored in said memory means;

second discrimination means for discriminating whether the recorded characters are comprised of superimposed characters;

third discriminating means for discriminating a dot recording density of the recorded characters; and control means for controlling an erasing mode of the recorded characters on the basis of the results of the first, second and third discriminating means, wherein said erasing means executes an erasing operation by erasing the area pattern when said first, second, and third discriminating means determine that at least one of the following conditions is satisfied: data corresponding to the character to be erased is not stored in said memory means, the recorded character is comprised of superimposed characters, and the dot recording density is equal to or greater than a standard dot recording density of the recorded character to be erased, and wherein said erasing means erases the character pattern based on the data of recorded characters stored in said memory means when it is discriminated that data corresponding to the character to be erased is stored in said memory means, the recorded character is not comprised of superimposed characters and the dot recording density is less than the standard dot recording density of the recorded character to be erased.

5. A document processing method, comprising the steps of:

erasing a recorded character pattern using one of a plurality of erasing processes, with one erasing process capable of erasing an area pattern defined by the width and height of the recorded character, and another erasing process capable of erasing a character pattern defined by the recorded character;

discriminating whether the recorded character pattern is comprised of superimposed characters; and executing the erasing process by erasing the area pattern when it is discriminated that the character pattern comprises superimposed characters, and by erasing the character pattern defined by the recorded character when it is discriminated that the character pattern does to comprise superimposed characters.

6. A character processing method, comprising the steps of:

erasing a recorded character pattern by either erasing an area pattern defined by the width and height of the recorded character or by erasing a character pattern defined by the recorded character;

storing data of the recorded characters in a memory;

initially discriminating whether data corresponding to the characters to be erased is stored in a memory;

secondly discriminating whether the recorded characters are composed of superimposed characters;

thirdly discriminating a dot recording density of the recorded characters;

controlling an erasing mode of the recording character on the basis of the results of the initial, second and third discriminating steps; and executing an erasing operation erasing the area pattern when it is discriminated that at least one of the following conditions is satisfied; data corresponding to the character to be erased is not stored in the memory, the recorded characters are comprised of superimposed characters, and the dot recording density is equal to or greater than a standard dot recording density of the recorded character to be erased, and executing an erasing operation erasing the character-erasing pattern based on the data of recorded characters stored in the memory when it is discriminated that data corresponding to the character to be erased is stored in the memory means, the recorded character is not comprised of superimposed characters, and the dot recording density is less than the standard dot recording density of the recorded character to be erased.

7. An apparatus according to claim 1, wherein said apparatus comprises an electronic typewriter.

8. An apparatus according to claim 1, further comprising means for receiving character data.

9. An apparatus according to claim 1, wherein said apparatus further comprises an ink sheet.

10. An apparatus according to claim 1, further comprising means for storing character data.

11. An apparatus according to claim 1, further comprising a thermal printer.

12. An apparatus according to claim 1, further comprising a display.

13. An apparatus according to claim 1, wherein said apparatus comprises means for editing character trains.

14. An apparatus according to claim 1, wherein the superimposed characters include superscript or subscript characters.

15. An apparatus according to claim 1, wherein said erasing means erased a recorded character pattern after thickening the character pattern.

16. An apparatus according to claim 1, wherein said erasing means erases a recorded character pattern based on a pattern formed by previously thickening the character pattern.

17. An apparatus according to claim 2, wherein said apparatus comprises an electronic typewriter.

18. An apparatus according to claim 2, further comprising means for receiving character data.

19. An apparatus according to claim 2, wherein said apparatus further comprises an ink sheet.

20. An apparatus according to claim 2, further comprising means for storing character data.

21. An apparatus according to claim 2, further comprising a thermal printer.

22. An apparatus according to claim 2, further comprising a display.

23. An apparatus according to claim 2, wherein said apparatus further comprises means for editing character trains.

24. An apparatus according to claim 2, wherein said erasing means erases a recorded character pattern after thickening the character pattern.

25. An apparatus according to claim 2, wherein said erasing means erases a recorded character pattern based on a pattern formed by previously thickening the character pattern.

26. An apparatus according to claim 3, wherein said apparatus comprises an electronic typewriter.

27. An apparatus according to claim 3, further comprising means for receiving character data.

28. An apparatus according to claim 3, wherein said apparatus further comprises an ink sheet.

29. An apparatus according to claim 3, further comprising means for storing character data.

30. An apparatus according to claim 3, further comprising a thermal printer.

31. An apparatus according to claim 3, further comprising a display.

32. An apparatus according to claim 3, wherein said apparatus further comprises means for editing character trains.

33. An apparatus according to claim 3, wherein said discriminating means discriminates a dot density of a character pattern to be erased by determining the number of dots comprising the character pattern in a unit area and comparing the dot density with a prestored standard dot density.

34. An apparatus according to claim 3, wherein said erasing means erases a recorded character pattern after thickening the character pattern.

35. An apparatus according to claim 3, wherein said erasing means erases a recorded character pattern based on a pattern formed by previously thickening the character pattern.

36. An apparatus according to claim 4, wherein said apparatus comprises an electronic typewriter.

37. An apparatus according to claim 4, further comprising means for receiving character data.

38. An apparatus according to claim 4, wherein said apparatus further comprises an ink sheet.

39. An apparatus according to claim 4, further comprising means for storing character data.

40. An apparatus according to claim 4, further comprising a thermal printer.

41. An apparatus according to claim 4, further comprising a display.

42. An apparatus according to claim 4, wherein said apparatus can edit character trains.

43. An apparatus according to claim 4, wherein the superimposed characters include superscript or subscript characters.

44. An apparatus according to claim 4, wherein said erasing means erases a recorded character pattern after thickening the character pattern.

45. An apparatus according to claim 4, wherein said erasing means erases a recorded character pattern based on a pattern formed by previously thickening the character pattern.

46. An apparatus according to claim 4, wherein said third discriminating means discriminates a dot recording density of the recorded characters by determining the number of dots of the recorded characters in a unit area.

47. A method of processing documents comprising the steps of:

erasing a recorded character pattern by erasing an area pattern defined by the width and height of a recorded character or by erasing a character pattern defined by the recorded character; and discriminating whether the character pattern to be erased comprises superimposed characters, wherein the area pattern is erased in said erasing step when said discriminating step determines that the character pattern comprises superimposed characters, and wherein the character pattern is erased by erasing a character pattern defined by the recorded character in said erasing step when said discriminating step determines that the character pattern does not comprise superimposed characters.

48. The method according to claim 47, wherein said discriminating step comprises the step of discriminating whether the character pattern to be erased comprises superimposed characters including superscript or subscript characters.

49. The method according to claim 47, wherein said erasing step erases the recorded character pattern after the recorded character pattern is thickened.

50. The method according to claim 47, wherein said erasing step erases the recorded character pattern based on a pattern formed by previously thickening the recorded character pattern.

51. A method of processing documents comprising the steps of:

storing recorded character patterns;

erasing a recorded character pattern by erasing an area pattern defined by the width and height of a recorded character or by erasing a character pattern defined by the recorded character;

discriminating whether the character pattern to be erased has been stored in said storing step; and determining whether to erase the area pattern or the character pattern based on the discriminating in said discriminating step, wherein the area pattern is erased in said erasing step when said discriminating step determines that the character pattern is not stored in said storing step, and wherein the character pattern is erased by erasing a character pattern defined by the recorded character in said erasing step when said discriminating step determines that the character pattern is stored in said storing step.

52. The method according to claim 51, wherein said erasing step erases the recorded character pattern after the recorded character pattern is thickened.

53. The method according to claim 51, wherein said erasing step erases the recorded character pattern based on a pattern formed by previously thickening the recorded character pattern.

54. A method of processing documents comprising the steps of:

erasing a recorded character pattern by erasing an area pattern defined by the width and height of a recorded character or by erasing a character pattern defined by the recorded character;

discriminating the dot density of the recorded character pattern to be erased by determining the number of dots of the recorded character pattern to be erased and comparing the dot density of the recorded character pattern to be erased with a prestored standard dot density; and determining an erasing mode in accordance with the dot density discriminated in said discriminating step, wherein the area pattern is erased in said erasing step when said discriminating step determines that the dot density of the recorded character pattern is equal to or greater than the standard dot density, and wherein the character pattern is erased by erasing a character pattern defined by the recorded character in said erasing step when said discriminating step determines that the dot density of the recorded character pattern is less than the standard dot density.

55. The method according to claim 54, wherein said discriminating step comprises the step of discriminating the dot density of the recorded character pattern to be erased by determining the number of dots of the recorded character pattern to be erased in a unit area and comparing the dot density of the recorded character pattern to be erased with a prestored standard dot density.

56. The method according to claims 54, wherein said erasing step erases the recorded character pattern after the recorded character pattern is thickened.

57. The method according to claim 54, wherein said erasing step erases the recorded character pattern based on a pattern formed by previously thickening the records character pattern.

58. A method of processing documents comprising the steps of:

erasing a recorded character pattern by erasing an area pattern defined by the width and height of a recorded character or by erasing a character pattern defined by the recorded character;

storing data representing recorded characters;

a first discriminating step of discriminating whether data corresponding to the recorded character pattern to be erased is stored in said storing step;

a second discriminating step of discriminating whether the recorded character pattern to be erased comprises superimposed characters;

a third discriminating step of discriminating the dot recording density of the recorded character pattern to be erased;

controlling the mode of erasing performed in said erasing step on the basis of the discriminating in said first, second, and third discriminating steps, wherein the area pattern is erased in said erasing step when said first, second, and third discriminating steps determine that at least one of the following three conditions is satisfied: data corresponding to the character to be erased is not stored in said storing step, the recorded character pattern comprises superimposed characters, and the dot recording density of the recorded character pattern to be erased is equal to or greater than the standard dot density, and wherein the character pattern is erased by erasing a character pattern defined by the recorded character in said erasing step when said first, second, and third discriminating steps determine that data corresponding to the character pattern to be erased is stored in said storing step, the recorded character pattern is not comprised of superimposed character, and the dot recording density of the character pattern to be erased is less than the standard dot recording density.

59. The method according to claim 58, wherein said first discriminating step comprises the step of discriminating whether the character pattern to be erased comprises superimposed characters including superscript or subscript characters.

60. The method according to claim 58, wherein said erasing step erases the recorded character pattern after the recorded character pattern is thickened.

61. The method according to claim 58, wherein said erasing step erases the recorded character pattern based on a pattern formed by previously thickening the records character pattern.

62. The method according to claim 58, wherein said third discriminating step comprises the step of discriminating the dot density of the recorded character pattern to be erased by determining the number of dots of the recorded character pattern to be erased in a unit area and comparing the dot density of the recorded character pattern to be erased with a prestored standard dot density.

* * * * *

UNITED STATES PATENT AND TRADEMARK OFFICE

CERTIFICATE OF CORRECTION

PATENT NO. : 5,127,753

DATED : July 7, 1992

INVENTOR(S) : HIDEO SHIBAOKA

It is certified that error appears in the above-identified patent and that said Letters Patent is hereby corrected as shown below:

[57] ABSTRACT

Line 2, "data" should read --data,-.

COLUMN 5

Line 66, "of" (second occurrence) should read --or--.

COLUMN 6

Line 3, "such using" should read --such by using--.

Line 19, "suing" should read --using--.

COLUMN 7

Line 28, "erased" should read --erases--.

COLUMN 8

Line 40, "to" should read --not--.

Line 61, "satisfied;" should read --satisfied:--.

UNITED STATES PATENT AND TRADEMARK OFFICE
CERTIFICATE OF CORRECTION

PATENT NO. : 5,127,753

DATED : July 7, 1992

INVENTOR(S) : HIDEO SHIBAOKA

It is certified that error appears in the above-identified patent and that said Letters Patent is hereby corrected as shown below:

COLUMN 9

Line 26, "erased" should read --erases--.

COLUMN 12

Line 7, "cords" should read --corded--.

Line 58, "cords" should read --corded--.

Signed and Sealed this

Twenty-eighth Day of September, 1993

Bruce Lehman

*Attest:*

BRUCE LEHMAN

*Attesting Officer*

*Commissioner of Patents and Trademarks*